US005213523A

United States Patent [19]

Hygema et al.

[11] Patent Number: 5,213,523

[45] Date of Patent: May 25, 1993

[54] APPARATUS AND METHOD OF MAKING AN ELECTRICAL CONNECTION TO A CURRENT CARRYING DEVICE

[75] Inventors: Terry L. Hygema, North Webster; Jack W. Fulk, Cromwell; Joe A. Chalk, Warsaw, all of Ind.

[73] Assignee: Heaters Engineering, Inc., North Webster, Ind.

[21] Appl. No.: 964,446

[22] Filed: Oct. 21, 1992

[51] Int. Cl.[5] ..... H01R 13/00

[52] U.S. Cl. ..... 439/620

[58] Field of Search ..... 439/620–622, 439/628, 682, 684–690

[56] References Cited

U.S. PATENT DOCUMENTS

| | | | |
|---|---|---|---|
| 3,088,087 | 4/1963 | Colten | 439/888 |
| 3,111,641 | 11/1963 | Wilentchik | 439/620 |
| 3,201,617 | 8/1965 | Pacoroni et al. | 439/620 |
| 4,846,701 | 7/1989 | Hayes et al. | 439/620 |

*Primary Examiner*—Joseph H. McGlynn
*Attorney, Agent, or Firm*—Barnes & Thornburg

[57] ABSTRACT

An apparatus for making an electrical connection from an electrical component to a current carrying device, such as from a lamp or heating element to blade-type power electrodes, includes first and second electrodes positioned a fixed distance apart, an electrical component having first and second leads and being configured to be slidably inserted between the blade electrodes so that the leads engage the electrodes to couple the electrical component thereto, and insulating material for encapsulating a portion of the plug and at least a portion of the electrical component to secure the component to the plug. The first and second electrodes are fixed a predetermined distance apart. The conductive leads of the electrical component are inserted between the first and second electrodes such that the respective leads engage each of the electrodes. At least portions of the electrodes and the component are then encapsulated with an insulated material to secure the electrical component to the electrodes. The apparatus and method is particularly well-suited for connecting a component such as a small lamp between blade electrodes which are spaced to be received by a common electrical outlet.

24 Claims, 1 Drawing Sheet

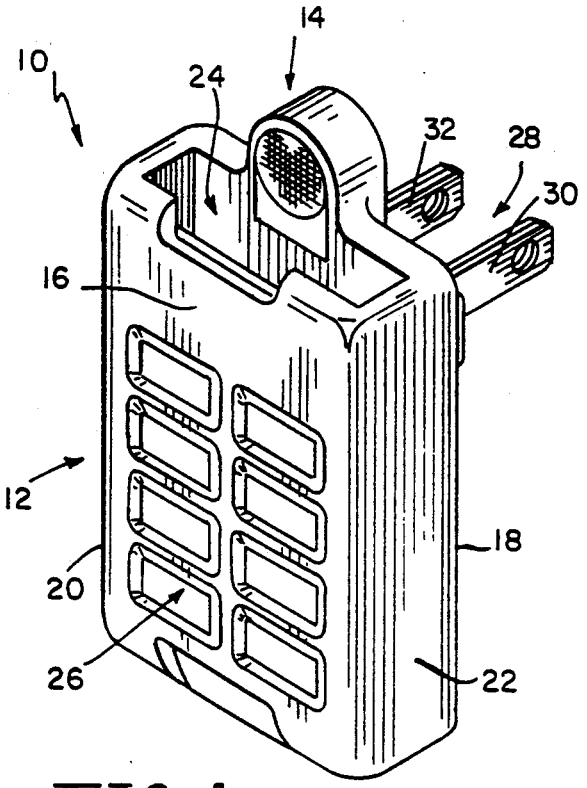
FIG. 1
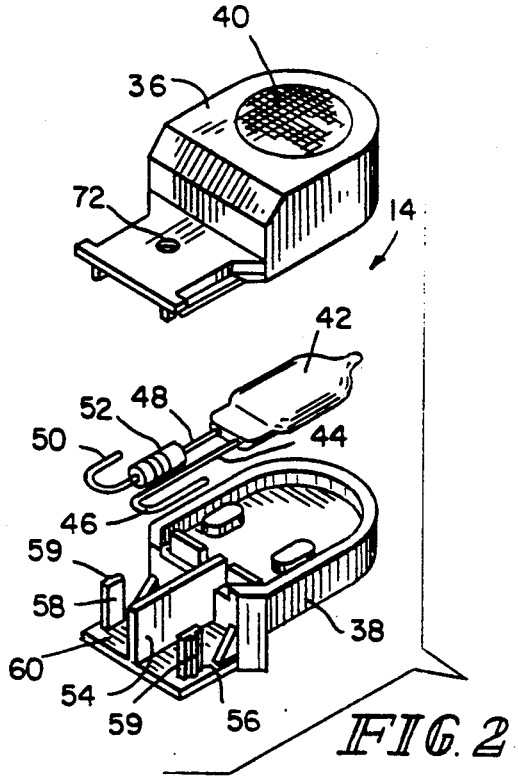
FIG. 2
FIG. 3
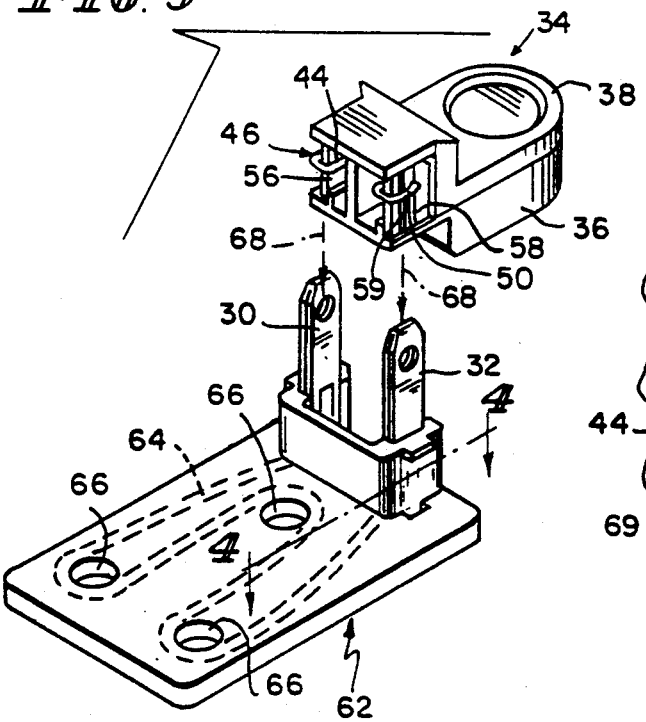
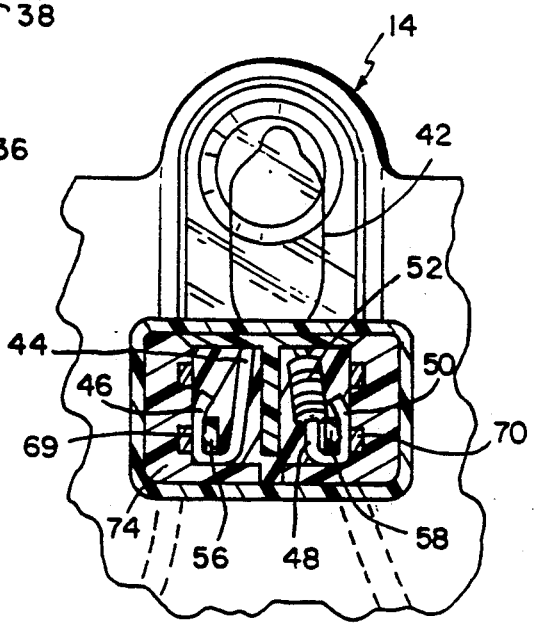
FIG. 4

APPARATUS AND METHOD OF MAKING AN ELECTRICAL CONNECTION TO A CURRENT CARRYING DEVICE

BACKGROUND AND SUMMARY OF THE INVENTION

The present invention relates to an apparatus and method of making an electrical connection from an electrical component to a current carrying device. More particularly, the present invention provides an apparatus and method of making a gas-tight, solderless, crimp-free, and insulated parallel electrical connection between first and second conductive leads of an electrical component and first and second current carrying electrodes.

It is often necessary or desirable to couple electrical components such as lamps, sensors, transducers, heating elements, timers, and signaling devices to current carrying devices such as connector terminals of power cord blade electrodes. Conventionally, electrical connections have been made using soldering or crimping technology which leaves the connections exposed and requires the addition of an electrical insulator.

The present invention finds particular utility when it is desired to couple a first electrical component having first and second electrodes for coupling the first electrical component to a power supply with a second electrical component having first and second conductive leads and an insulated base. The first and second electrodes of the first electrical component are fixed a predetermined distance apart by a circuit board, a molded plug, a molded housing, or by some other mechanical means. The conductive leads of the second electrical component are made of solid wire, foil, stamped sheet metal, or other material coated or plated with a conductive material.

According to one aspect of the present invention, an assembly is provided which includes a power plug having first and second blade electrodes positioned a fixed distance apart. The assembly also includes an electrical component having first and second conductive leads extending from the electrical component. The electrical component is configured to be slidably inserted between said first and second blade electrodes so that the first conductive lead engages the first blade electrode and the second conductive lead engages the second blade electrode, respectively, to couple the electrical component to the power plug electrically. The assembly further includes means for encapsulating a portion of the power plug and at least a portion of the electrical component with an insulating material to secure the electrical component to the power plug.

According to another aspect of the present invention, the electrical component includes an insulated housing and the first and second conductive leads extend outwardly from the insulated housing. The insulated housing includes first and second contact spring support posts which abut the first and second conductive leads, respectively. The first and second contact spring support posts hold the first and second conductive leads against the first and second blade electrodes, respectively, upon insertion of the electrical component between said first and second blade electrodes. The connection between the first and second conductive leads and the first and second blade electrodes is enhanced by forming a rib on an outside face of each of the spring support posts to concentrate the force of the first and second spring support posts against the first and second blade electrodes, respectively. The insulated housing further includes a partition formed between the first and second contact support posts for separating the first conductive lead from the second conductive lead. An electrical device, such as a lamp, is positioned within the interior region, and a voltage dropping resistor coupled to one of the conductive leads. The first and second blade electrodes receive the spring tension created by the first and second contact spring support posts on the inserted electrical component retaining the electrical component in position between the first and second blade electrodes of the power plug to provide a gas-type, solderless, and crimp free connection.

According to yet another aspect of the present invention, a first electrical component is provided which is coupled to the first and second electrodes to position the first and second electrodes a fixed distance apart. A second electrical component including an insulated base and first and second conductive leads is also provided. The second electrical component is configured to be slidably inserted between said first and second electrodes so that the first conductive lead engages the first electrode and the second conductive lead engages the second electrode, respectively, to couple the first and second electrical components together electrically. The encapsulating means surrounds a portion of first electrical component and a portion of the second electrical component with an insulating material to secure the first electrical component to the second electrical component and to maintain the electrical connection therebetween.

According to still another aspect of the present invention, a method is provided for electrically coupling an electrical component including first and second conductive leads to first and second electrodes. The method includes the step of fixing the first and second electrodes a predetermined distance apart. The method also includes the step of inserting the electrical component between the first and second electrodes so that the first conductive lead of the electrical component engages the first electrode and the second conductive lead of the electrical component engages the second electrode. The method further includes the step of encapsulating a portion of the first and second electrodes and a portion of the electrical component with an insulating material to secure the electrical component to the first and second electrodes.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which:

FIG. 1 is a perspective view of an electrically heated vapor dispensing apparatus which includes an integral light assembly constructed according to the present invention;

FIG. 2 is an exploded perspective view illustrating the configuration of the light assembly of the present invention;

FIG. 3 is an exploded perspective view illustrated installation of the light assembly between spaced apart power plug electrodes coupled to a heater assembly in a premolded base; and FIG. 4 is a sectional view taken along lines 4—4 of FIG. 3 illustrating the configuration of the light assembly coupled to the plug assembly after the assembly has been encapsulated to form the final product as illustrated in FIG. 1.

DETAILED DESCRIPTION OF THE DRAWINGS

Referring now to the drawings, FIG. 1 illustrates an assembly 10 constructed according to the present invention. The assembly 10 includes a heater portion 12 shown in FIG. 1 and a light assembly 14 shown in FIG. 2. Heater portion 12 includes a front wall 16, a rear wall 18, and opposite side walls 20 and 22. The assembly 10 is formed to include a slot 24 extending along heater portion 12 for receiving a container (not shown) therein. The container (not shown) can be filled with any suitable air treating volatile material, such as an air deodorizer, insecticide, or the like. The heater portion 12 and container (not shown) are described in detail in U.S. Pat. No. 4,849,606. Front wall 16 is formed to include a plurality of apertures 26 to permit the volatile material to escape. Assembly 10 is designed to be plugged into a conventional wall outlet by power plug assembly 28 including a first blade electrode 30 and a second blade electrode 32 spaced apart from the first blade electrode 30 by a fixed distance. Electrodes 30 and 32 are made of brass or some other conductive material. Light assembly 14 shown in FIG. 2 is electrically coupled to first and second blade electrodes 30 and 32. Light assembly 14 is continuously illuminated after the assembly 10 is plugged into a wall outlet to provide a night light. The combination of heater portion 12 and night light 14 permits a single wall outlet socket to be used for both the volatile material dispenser and a night light. This leaves additional wall outlet sockets available for use with other electrical appliances.

Light assembly 14 of the present invention is best illustrated in FIG. 2. Light assembly 14 includes an insulated base or housing 34 illustrated in FIG. 3. Illustratively, housing 34 includes a front section 36 and a rear section 38. In another embodiment, housing 34 may be a single piece housing. Front and rear sections 36 and 38 are preferably formed from a rigid plastic material which transmits light. However, housing 34 may be made from other materials including rubber, paper, phenolic, epoxy, or other nonconductive material. Front section 36 includes a light diffusing section 40 to diffuse light emitted from a lamp 42 located inside insulated housing 34. First conductive lead 44 and second conductive lead 48 are coupled to lamp 42. First lead 44 includes a first contact section 46. Second lead 48 includes a second contact section 50. A voltage dropping resistor 52 is coupled in series with second lead 48 to provide current to lamp 42. Rear section 38 of insulated base 34 includes a center partition 54, a first contact spring support post 56, and a second contact spring support post 58, each extending upwardly from a rear surface 60 of rear section 38. A rib 59 is formed on each of the first and second contact support posts 56 and 58. Leads 44 and 48 are positioned on opposite sides of partition 54 to separate the leads 44 and 48.

Housing 34 is fabricated to provide exposed surfaces along which contact sections 46 and 50 are positioned. The exposed surfaces may be along the external sides of housing 34 as illustrated in FIGS. 2 and 3. Alternately, contacts sections 46 and 50 may extend outwardly from holes in housing 34. The assembled light assembly 14 is illustrated in FIG. 3. First and second contact surfaces 46 and 50 abut ribs 59 or contact support posts 56 and 58, respectively. Light assembly 14 is inserted into a premolded heater base 62 illustrated in FIG. 3.

A coil of wire is wrapped around a non-conductive filament as illustrated by dotted lines 64 to form a heating element for heater assembly 12. Opposite ends of the coiled wire 64 are coupled to blade electrodes 30 and 32. The wire 64 is wrapped around three posts (not shown) in a mold. The position of the three posts is illustrated at locations 66. Base 62 is then premolded to encapsulate the coil wire wrapped filament 64 and blades 30 and 32 in an insulated material to form the rigid, premolded heater base 62. Blade electrodes 30 and 32 are spaced apart by a fixed predetermined distance. First and second contacts 46 and 50 of light assembly 14 are spaced apart a slightly greater distance than the predetermined distance.

Light assembly 14 is pressed or inserted between first and second blade electrodes 30 and 32 in the direction of arrows 68 in FIG. 3. By sliding light assembly 14 downwardly in the direction of arrows 68 first contact 46 engages first blade electrode 30 to provide electrical contact therewith. Second contact 50 engages second blade electrode 32 to provide electrical contact therewith. This provides an electrical connection between light assembly 14 and premolded heater base 62. Contact section 46 of conductive lead 44 is thus trapped between rib 59 of first contact spring support post 56 and first electrode 30, and contact section 50 of conductive leads 48 is trapped between rib 59 of second contact spring support post 58 and second electrode 32. Ribs 59 concentrate the force applied by contact spring support posts 56 and 58 against leads 46 and 50, respectively. Therefore, a gas-tight, solderless, and crimp free electrical connection is made between power plug assembly 28 and light assembly 14. Contacts 46 and 50 provide a wiping action as they are pressed between electrodes 30 and 32. This wiping action tends to cut through insulating oxidation which may be present on the contacts 46 and 50 or electrodes 30 and 32.

Light assembly 14 and premolded heater base 62 are then overmolded with an insulating material which forms the lighted power plug assembly 10 illustrated in FIG. 1. This overmolding is done using conventional injection molding techniques. FIG. 4 illustrates the light assembly 14 after it has been overmolded to form assembly 10. FIG. 4 illustrates that first contact 46 engages a portion 69 of first blade electrode 30. Contact 50 engages a portion 70 of second blade electrode 32. First contact spring support post 56 holds first contact 46 in engagement with first blade electrode 30, and second contact spring support post 58 holds second contact 50 in engagement with second blade electrode 32. Therefore, the present invention permits coupling of light assembly 14 to premolded heater base 62 without the use of soldering or crimp-type connections. As light assembly 14 and premolded heater base 62 are overmolded, insulating material passes through an aperture 72 in front section 36 of light assembly 14 illustrated in FIG. 2 and fills a region 74 illustrated in FIG. 4 to help secure the leads 46 and 50 against the first and second blade electrodes 30 and 32, respectively.

Although the invention has been described in detail with reference to a certain preferred embodiment, variations and modifications exist within the scope and spirit of the invention as described and defined in the following claims.

What is claimed is:

1. An assembly comprising:

a power plug including first and second blade electrodes positioned a fixed distance apart;

an electrical component including first and second conductive leads extending from the electrical component, the electrical component being configured to be slidably inserted between said first and second blade electrodes so that the first conductive lead engages the first blade electrode and the second conductive lead engages the second blade electrode, respectively, to couple the electrical component to the power plug electrically; and means for encapsulating a portion of the power plug and at least a portion of the electrical component with an insulating material to secure the electrical component to the power plug.

2. The assembly of claim 1, wherein the electrical component includes an insulated housing and the first and second conductive leads extend outwardly from the insulated housing.

3. The assembly of claim 2, wherein the insulated housing includes first and second contact spring support posts abutting the first and second conductive leads, the first and second contact spring support posts holding the first and second conductive leads against the first and second blade electrodes, respectively, upon insertion of the electrical component between said first and second blade electrodes.

4. The assembly of claim 3, wherein the insulated housing further includes a partition formed between the first and second contact support posts for separating the first conductive lead from the second conductive lead.

5. The assembly of claim 3, further comprising first and second ribs formed on the first and second contacts spring support posts, respectively, to concentrate the force applied by the first and second contact spring support posts against the first and second conductive leads.

6. The assembly of claim 2, wherein the insulated housing includes a front portion and a rear portion coupled to the front portion to define an interior region therebetween and a current carrying device positioned within the interior region.

7. The assembly of claim 6, further comprising a voltage dropping resistor coupled to the first conductive lead.

8. A method for electrically coupling an electrical component including first and second conductive leads to first and second electrodes, the method comprising the steps of:

fixing the first and second electrodes a predetermined distance apart;

inserting the electrical component between the first and second electrodes so that the first conductive lead of the electrical component engages the first electrode and the second conductive lead of the electrical component engages the second electrode; and encapsulating a portion of the first and second electrodes and a portion of the electrical component with an insulating material to secure the electrical component to the first and second electrodes.

9. The method of claim 8, further comprising the step of coupling a heating wire to the electrodes prior to the fixing step, and wherein the fixing step of fixing the first and second electrodes a predetermined distance apart includes the step of and encapsulating the heating wire and a portion of the first and second electrodes to form a premolded base by including the heating wire and the first and second electrodes.

10. The method of claim 8, wherein the electrical component includes an insulated housing and the first and second conductive leads extend outwardly from the insulated housing.

11. The method of claim 10, wherein the insulated housing includes first and second contact spring support posts abutting the first and second conductive leads, the first and second contact spring support posts holding the first and second conductive leads against the first and second electrodes, respectively, upon insertion of the electrical component between said first and second electrodes.

12. The assembly of claim 11, wherein the insulated housing further includes a partition formed on the insulated housing between the first and second contact spring support posts for separating the first conductive lead from the second conductive lead.

13. The assembly of claim 10, wherein the insulated housing includes a front portion and a rear portion coupled to the front portion to define an interior region therebetween and a current carrying device positioned within the interior region.

14. The assembly of claim 13, further comprising a voltage dropping resistor coupled to the first conductive lead.

15. An assembly comprising:

a first electrical component including first and second electrodes positioned a fixed distance apart;

a second electrical component including an insulated base and first and second conductive leads, the second electrical component being configured to be slidably inserted between said first and second electrodes so that the first conductive lead engages the first electrode and the second conductive lead engages the second electrode, respectively, to couple the first and second electrodes and the electrical component together electrically; and means for encapsulating a portion of first electrical component and a portion of the second electrical component with an insulating material to secure the first electrical component to the second electrical component and to maintain the electrical connection therebetween.

16. The assembly of claim 15, wherein the second electrical component includes an insulated housing and the first and second conductive leads extend outwardly from the insulated housing.

17. The assembly of claim 16, wherein the insulated housing includes first and second contact spring support posts abutting the first and second conductive leads, the first and second contact spring support posts holding the first and second conductive leads against the first and second electrodes, respectively, upon insertion of the second electrical component between said first and second electrodes.

18. The assembly of claim 17, wherein the insulated housing further includes a partition formed on the insulated housing between the first and second contact spring support posts for separating the first conductive lead from the second conductive lead.

19. The assembly of claim 17, further comprising first and second ribs formed on the first and second contact spring support posts, respectively, to concentrate the force applied by the first and second contact spring support posts against the first and second conductive leads.

20. The assembly of claim 16, wherein the insulated housing includes a front portion and a rear portion coupled to the front portion to define an interior region therebetween and a current carrying device positioned within the interior region.

21. The assembly of claim 20, further comprising a voltage dropping resistor coupled to the first conductive lead.

22. The assembly of claim 15, the first electrical component includes a heating wire coupled to the first and second electrodes and a premolded base encapsulating the heating wire and a portion of the first and second electrodes to position the first and second electrodes said fixed distance apart.

23. The assembly of claim 22, wherein the encapsulating means is formed to include a slot adjacent the heating wire for receiving a volatile material dispenser therein.

24. The assembly of claim 22, wherein the encapsulating is further formed to include a plurality of apertures in communication with said slot to permit the volatile material to pass through the plurality of apertures.

* * * * *